US005784849A

United States Patent [19]

DeVon et al.

[11] Patent Number: 5,784,849

[45] Date of Patent: *Jul. 28, 1998

[54] FLOOR FRAME ASSEMBLY

[75] Inventors: David L. DeVon, Elkhart; Brian J. Ellias, Granger; David E. Ganger, Goshen, all of Ind.; John F. Hughes, Edwardsburg, Mich.

[73] Assignee: Banks Lumber Company, Inc., Elkhart, Ind.

[ * ] Notice: The term of this patent shall not extend beyond the expiration date of Pat. No. 5,579,622.

[21] Appl. No.: 744,984

[22] Filed: Nov. 7, 1996

Related U.S. Application Data

[63] Continuation of Ser. No. 232,803, Apr. 22, 1994, Pat. No. 5,579,622.

[51] Int. Cl.[6] ..... E04C 2/38

[52] U.S. Cl. ..... 52/653.1; 52/656.1; 52/143; 296/181; 296/182; 280/789

[58] Field of Search ..... 52/143, 272, 274, 52/299, 653.1, 656.1, 690, 693; 296/181, 182, 204; 280/785, 789

[56] References Cited

U.S. PATENT DOCUMENTS

| | | | |
|---|---|---|---|
| 3,024,423 | 7/1962 | Bock | 280/789 |
| 3,716,267 | 2/1973 | Lindsay . | |
| 3,751,870 | 8/1973 | Vesei . | |
| 4,015,375 | 4/1977 | Lindsay . | |
| 4,019,299 | 4/1977 | Lindsay . | |
| 4,106,258 | 8/1978 | Lindsay . | |
| 4,232,884 | 11/1980 | DeWitt | 280/789 X |
| 4,863,189 | 9/1989 | Lindsay . | |
| 4,930,809 | 6/1990 | Lindsay . | |
| 5,028,072 | 7/1991 | Lindsay . | |
| 5,201,546 | 4/1993 | Lindsay . | |
| 5,226,583 | 7/1993 | Imashimizu et al. . | |
| 5,640,814 | 6/1997 | Godfrey | 52/143 |

*Primary Examiner*—Wynn E. Wood
*Assistant Examiner*—Laura A. Callo
*Attorney, Agent, or Firm*—Clifford W. Browning; Woodard, Emhardt, Naughton Moriarty & McNett

[57] ABSTRACT

A floor frame assembly for facilitating the construction of buildings including mobile homes and modular homes. The floor frame assembly includes longtitudinally extending structural support beams which are arranged side by side. The structural support beams are rigidly connected by a plurality of cross members extending therebetween. A plurality of one-piece outriggers are separately secured to the longtitudinal beams and transversely extend laterally outward therefrom The outriggers are substantially rectangular in shape.

8 Claims, 3 Drawing Sheets

FLOOR FRAME ASSEMBLY

This application is a continuation of application Ser. No. 08/232803, filed Apr. 22, 1994, (status, now U.S. Pat. No. 5,579,622).

BACKGROUND OF THE INVENTION

The present invention relates to a floor frame assembly, and, in particular, to a floor frame assembly frequently employed in the construction of mobile homes and modular housing.

Floor frame assemblies are prefabricated structures typically used to facilitate the construction of buildings, including buildings such as mobile homes and modular houses. Those assemblies that satisfy government specifications are used in the construction of HUD code houses and BOCA code houses.

Floor frame assemblies are normally manufactured or mass produced to lower costs at a convenient site remote from the eventual location of a building. Mobile home or manufactured housing manufacturers use such assemblies to construct a building structure at a factory location. These building structure units which are sized to be transportable as constructed typically each use a single, specially designed floor frame assembly to serve as the entire floor support of the unit. Manufactured housing units may employ two or more floor frame assemblies, each of which provides a structurally sound base upon which to construct a different portion of a finished unit. After the finished portions are individually transported to a final destination, the floor frame assemblies are interconnected-to create a stable home base, and added roofing and siding conceals the fact that the house was initially formed in multiple pieces.

Typical existing floor frame assemblies, while useful to speed the construction of buildings, are not without their shortcomings. For example, it is usual for the assemblies to include outriggers, disposed on longitudinal beams, that extend laterally upwardly, necessitating wood fabrication build up in order to be leveled for support upon foundation walls or attached to an adjacent assembly. Other known floor frame assemblies such as seen in U.S. Pat. Nos. 4,015,375 and 4,106,258 have outriggers, which are built up from several separate wood or metal components. These types of assemblies, in addition to being more expensive to construct due to the number of independent components, are sometimes more difficult to install. Thus, it is desirable to provide a floor frame assembly which provides adequate strength to the floor frame and which simplifies building construction.

SUMMARY OF THE INVENTION

In one form thereof, the present invention provides a floor frame assembly including first and second longitudinal support beams. The first and second support beams, which are arranged parallel to each other, each include an outward directed side surface and an inward directed side surface. The assembly also includes a plurality of cross members which extend from one inward side surface to the other inward side surface of the first and second structural support beams and connect the beams together. The assembly also includes outwardly extending rectangular, one-piece outriggers secured to each of the first and second structural support beams at their outward directed side surfaces.

An advantage of the floor frame assembly of the present invention is that the outriggers utilized do not require wood build up for mounting upon a foundation, thereby simplifying construction. Another advantage of the floor frame assembly of the present invention is that the outriggers utilized may be relatively inexpensive due to their one-piece construction. Still another advantage of the floor frame assembly of the present invention is that the one-piece outriggers utilized are both rigid and strong enough for expected use conditions. Other advantages of the present invention will become apparent from the following description.

DESCRIPTION OF THE PREFERRED EMBODIMENT

The preferred embodiment illustrated is not intended to be exhaustive or to limit the invention to the precise form disclosed. The embodiment was chosen and described in order to best explain the principles of the invention and its application and practical use to thereby enable others skilled in the art to best utilize the invention.

Figure 1:
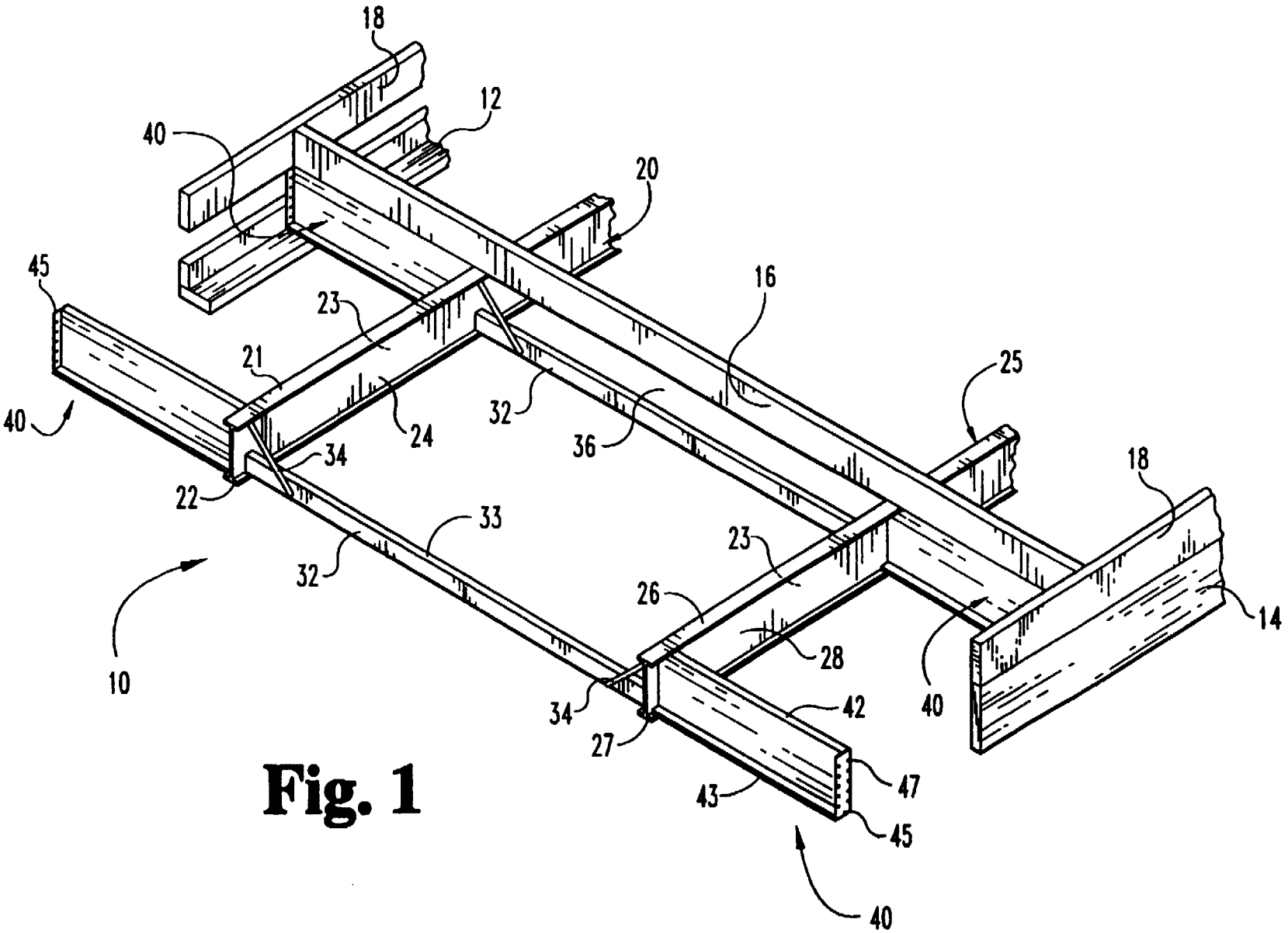
FIG. 1 shows a fragmented top perspective view of a one end portion of the floor frame assembly of the present invention, wherein portions of the associated wall beam, perimeter rails, and floor joist assembly are also shown.

Referring to FIG. 1, there is shown a perspective view of an end portion of the floor frame assembly of the present invention, generally designated 10. Disposed on opposite sides of floor frame assembly 10 are outside wall perimeter rails 12 and an inside or mating wall beam 14, all made of wood. A floor joist assembly made of wood and juxtaposed over frame assembly 10 includes longitudinal floor beams 18 and transverse floor joists 16 upon which flooring (not shown) is eventually installed. Although generally coterminous with floor frame assembly 10, perimeter rails 12, mating wall beam 14, and the floor joist assembly are shown fragmented in the Figures for purposes of better illustrating the construction of floor frame assembly 10.

Still referring to FIG. 1, floor frame assembly 10 is fabricated from steel that provides sufficient strength and rigidity to withstand expected uses. Floor frame assembly 10 includes a pair of longitudinal support beams 20, 25 which run the length of assembly 10. Arranged side by side and disposed horizontally, support beams 20, 25 are preferably parallel in alignment. Support beam 20 includes a top flange 21, a bottom flange 22, an outwardly directed side surface 23, and an inwardly directed side surface 24. Support beam 25 similarly includes a top flange 26, a bottom surface 27, an outwardly directed side surface 28, and an inwardly directed side surface 29 which faces side surface 24 of beam 20. While shown as being I-beams, beams 20, 25 could also be constructed from beams with different cross-sections.

A series of spaced, parallel cross members 32, extending between support beams 20, 25, are securely fastened by welding to the inwardly directed side surfaces 24, 29 of beams 20, 25. Tie rods 34 disposed at either end of each cross member 32 further secure each cross member 32 with beams 20, 25. The top surface 33 of each cross member 32 is disposed below the support beams top flanges 21, 26. As a result, when floor joists 16 span beams 20, 25, a space or opening 36 exists between joists 16 and cross members 32 through which electrical conduits, ventilation ductwork, and other building services can be circuited.

Still referring to FIG. 1, a series of parallel outwardly extending outriggers 40 are positioned along support beams 20, 25. In the preferred embodiment, each outrigger 40 is similarly constructed, and consequently the following explanation with respect to a single outrigger 40 has equal application to the other outriggers. Outrigger 40, which is of a one-piece construction, is substantially rectangular in profiled shape and Z-shaped in cross-section as shown. The rectangular shape of outrigger 40 is defined by a top flange 42, a bottom flange 43, an inner end which terminates at and is securely connected, preferably by welding, to outwardly directed side surfaces 23, 28 of beams 20, 25, and an outward surface to which is welded or otherwise connected a mounting plate. As outrigger 40 is generally the same height as support beams 20, 25, top and bottom flanges 42, 43 of outrigger 40 are respectively coplanar with the top and bottom flanges of the beams. Mounting plate 45, which is as wide as the longitudinal extent of the flanges of outrigger 40, includes numerous apertures 47 through which fasteners such as nails, bolts or the like are passed during fabrication of the structure being constructed. In addition, while still maintaining a substantially rectangular profiled shape, outrigger 40 could be formed with different cross-sections, including I-shaped or C-shaped cross-sections.

Still referring to FIG. 1, during the initial stages of building construction, outside wall perimeter rails 12 and a wall beam 14 are securely and rigidly attached to floor frame assembly 10. The floor joist assembly which includes joists 16 and beams 18 is then installed over floor frame assembly 10.

Figure 2:
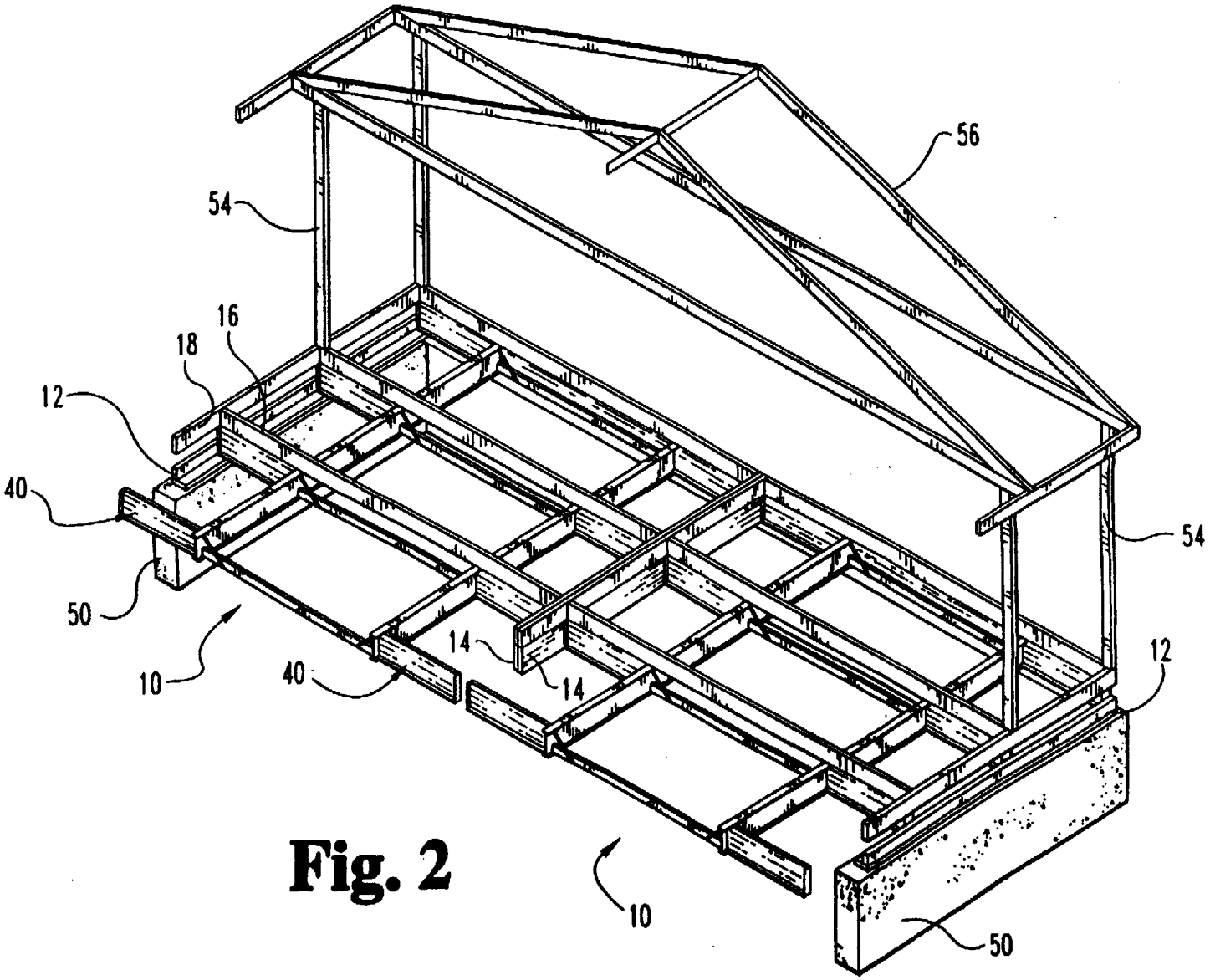
FIG. 2 shows a perspective view of two floor frame assemblies placed on a building foundation and with parts of the building framework installed thereon.
Figure 3:
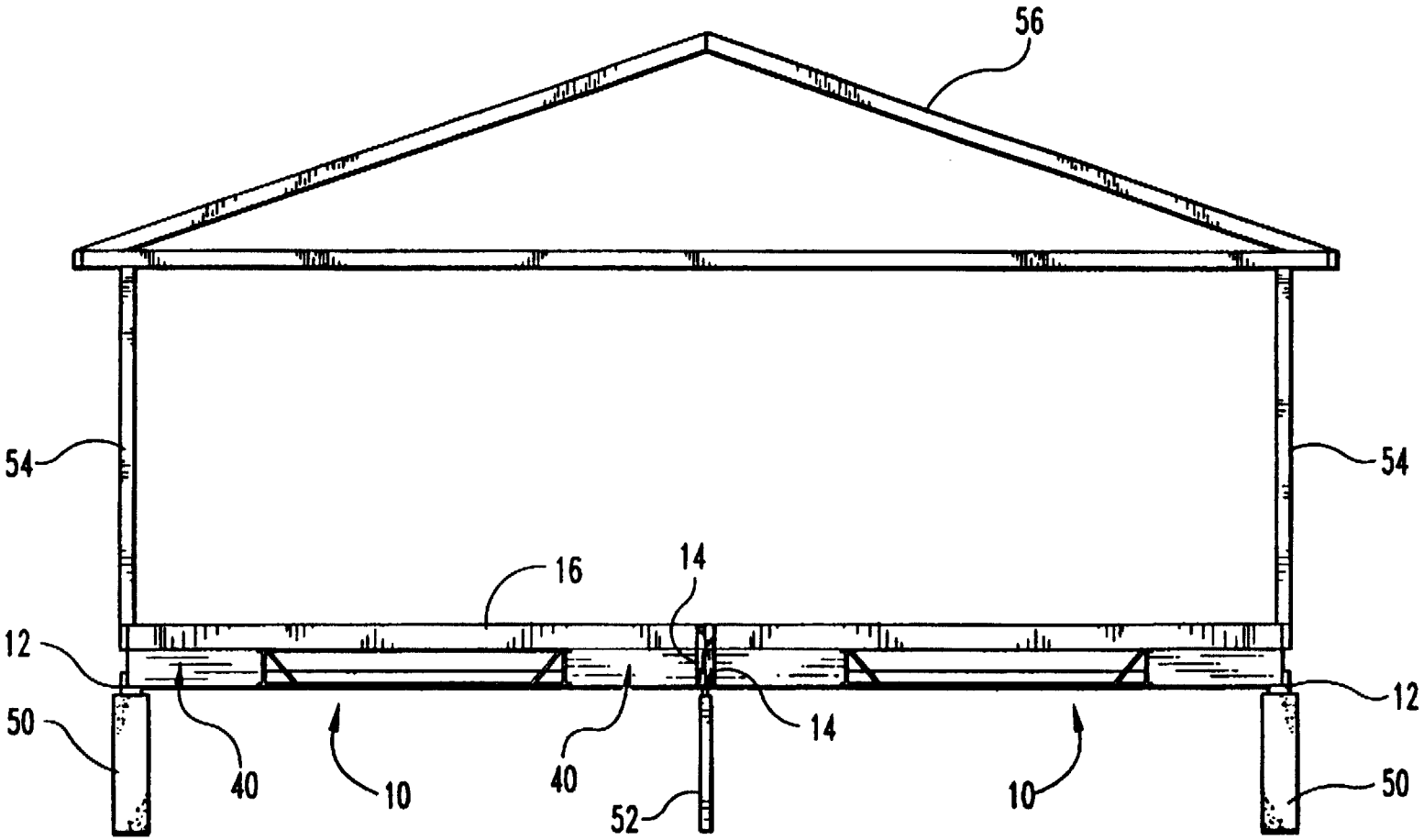
FIG. 3 shows an end view of the building shown in FIG. 2. Corresponding reference characters indicate corresponding parts throughout the several figures.

Two floor frame assemblies 10 are shown being used to construct a building on a walled foundation 50 in FIGS. 2 and 3. Perimeter rails 12 rest directly on and are supported by opposite foundation walls 50. In some frame assemblies, rails 12 could be omitted so that outriggers 40 rest upon foundation walls 50. Facing wall beams 14 are bolted or otherwise fastened together, thereby rigidly securing together assemblies 10. As shown in FIG. 3, jack-post 52 is positioned directly underneath the attached wall beams 14, to provide a central support for assemblies 10.

After installation of floor frame assemblies 10 as shown in FIGS. 2 and 3, side wall framing 54 and roof trusses 56 can be built over the floor joist assemblies in preparation for the application of siding and roofing. In modern housing, each floor frame assembly 10 will carry a portion of the wall and roof structure for the building. When the frame assemblies are placed upon the prepared foundation and joined at beams 14, a complete housing structure is fabricated except for finishing.

While this invention has been described as having a preferred design, the present invention may be further modified within the spirit and scope of this disclosure and the appended claims. For example, additional longitudinal beams or outriggers than shown could be employed. For some applications, a single floor frame assembly 10 could be used. Other times, three or more such assemblies could be set upon a foundation. This application is therefore intended to cover any variations, uses, or adaptations of the invention using its general principles. Further, this application is intended to cover such departures from the present disclosure as come within known or customary practice in the art to which this invention pertains.

What is claimed is:

1. A floor frame assembly comprising:

first and second structural support beams, said first and second structural support beams arranged side by side and extending in a longitudinal direction, said first structural support beam including an outwardly directed side surface and an inwardly directed side surface, said second structural support beam including an outwardly directed side surface, and an inwardly directed side surface, said first structural support beam inwardly directed side surface facing said second structural support beam inwardly directed side surface;

a plurality of cross members connecting said first structural support beam to said second structural beam and extending from one of said inwardly directed side surfaces to the other, each of said cross members having a top surface and a bottom surface;

a first plurality of outriggers, each rigidly secured to said first structural support beam and extending transversely from said first structural support beam's outwardly directed side surface, said outriggers each including a one-piece construction and having a substantially rectangular shape defined by a top surface, a bottom surface, an inner end joined to said first structural support beam, and an outer end;

a second plurality of outriggers each rigidly secured to said second structural support beam and extending transversely from said second structural support beam's outwardly directed side surface, said outriggers each including a one-piece construction and having a substantially rectangular shape defined by a top surface, a bottom surface, an inner end joined to said second structural support beam, and an outer end;

said first and second plurality of outriggers constituting means for overlying and being supported by building supports to elevate said floor frame assembly.

2. The floor frame assembly of claim 1 wherein said outer ends of said first plurality of outriggers each include a mounting plate, and wherein each said mounting plate has a plurality of fastener receiving apertures.

3. The floor frame assembly of claim 1 wherein said top surfaces of said first plurality of outriggers are substantially coplanar with a top surface of said first structural support beam, and wherein said top surfaces of said second plurality of outriggers are substantially coplanar with a top surface of said second structural support beam.

4. The floor assembly of claim 3, wherein said bottom surfaces of said cross members are substantially coplanar with bottom surfaces of said first and second structural support beams, and wherein said top surfaces of said cross members are not coplanar with top surfaces of said first and said second structural support beams.

5. A combination comprising a plurality of floor frame assemblies set upon a foundation, each of said floor frame assemblies including first and second structural support beams, said first and second structural support beams arranged side by side and extending in a longitudinal direction, said first structural support beam including an outwardly directed side surface and an inwardly directed side surface, said second structural support beam including an outwardly directed side surface and an inwardly directed side surface, said first structural support beam inwardly directed side surface faces said second structural support beam inwardly directed side surface;

each of said floor frame assemblies further including a plurality of cross members connecting said first structural support beam to said second structural support beam from one of said inwardly directed side surfaces to the other, each of said cross members having a top surface and a bottom surface;

each of said floor frame assemblies further including a first plurality of outriggers each rigidly secured to said first structural support beam and extending transversely from said first structural support beam outwardly directed side surface and a second plurality of outriggers each rigidly secured to said second structural support beam and extending transversely from said second structural support beam outwardly directed side surface and each of said outriggers being of a rectangular shape, having a top surface, a bottom surface, and an outer end; and each of said floor frame assemblies further including a beam member connected across said outer ends of at least said first plurality of outriggers;

said plurality of floor frame assemblies being secured together with one of said beam members abutted and connected to another of said beam members; and the said second plurality of outriggers of at least two of said floor frame assemblies being supported upon said foundation.

6. The combination of claim 5 wherein said outer ends of said first plurality of outriggers each include a mounting plate, and wherein each said mounting plate has a plurality of fastener receiving apertures.

7. The floor frame assembly of claim 5 wherein said bottom surfaces of said first plurality of outriggers are substantially coplanar with a bottom surface of said first structural support beam, and wherein said bottom surfaces of said second plurality of outriggers are substantially coplanar with a bottom surface of said second structural support beam.

8. The combination of claim 7 wherein said bottom surfaces of said cross members are substantially coplanar with the bottom surfaces of said first and second structural support beams, and wherein said top surfaces of said cross beams are not coplanar with top surfaces of said first and said second structural support beams.

* * * * *

UNITED STATES PATENT AND TRADEMARK OFFICE

CERTIFICATE OF CORRECTION

PATENT NO : 5,784,849

DATED : July 28, 1998

INVENTOR(S): David L. DeVon, et al.

It is certified that error appears in the above-identified patent and that said Letters Patent are hereby corrected as shown below:

On cover page, under References Cited, U.S. Patent Documents:

change "3,024,423" to read "3,042,423 insert references:

| | | | |
|---|---|---|---|
| 5,468,008 | 11/1995 | Hecht | 280/789X |
| 5,488,809 | 2/1996 | Lindsay | 52,143X |
| 5,553,989 | 9/1996 | Ullman | 280/789X |
| 5,579,622 | 12/1996 | DeVon et al | 52/653.1 |

Signed and Sealed this

Seventeenth Day of November, 1998

Bruce Lehman

*Attest:*

BRUCE LEHMAN

*Attesting Officer*

*Commissioner of Patents and Trademarks*